US005341542A

United States Patent [19]

Hannan et al.

[11] Patent Number: 5,341,542

[45] Date of Patent: Aug. 30, 1994

[54] ANTI-TIP HINGE DEVICE AND METHOD

[75] Inventors: Edward J. Hannan, Muncy; George H. Schneider, Williamsport, both of Pa.

[73] Assignee: Keystone Friction Hinge Co., South Williamsport, Pa.

[21] Appl. No.: 956,227

[22] Filed: Oct. 5, 1992

[51] Int. Cl.[5] ..... E05F 1/08; E05D 11/06; F23M 7/00; A47B 88/00

[52] U.S. Cl. ..... 16/289; 16/375; 312/319.4; 126/194

[58] Field of Search ..... 16/278, 289, 375; 126/194; 312/319.4

[56] References Cited

U.S. PATENT DOCUMENTS

| | | | |
|---|---|---|---|
| 3,046,974 | 7/1962 | Kimberley | 126/191 |
| 3,603,658 | 9/1971 | Bergeson | 126/191 |
| 3,698,781 | 10/1972 | Dunn | 126/194 |
| 4,096,602 | 6/1978 | Nelson | 126/194 |
| 5,025,776 | 6/1991 | Hanley et al. | 126/194 |

*Primary Examiner*—Carmine Cuda
*Attorney, Agent, or Firm*—Arnold B. Silverman; Suzanne Kikel

[57] ABSTRACT

An anti-tip hinge device for a door or a shelf, which is pivotally moved to obtain a horizontal cantilever position. The hinge device has a channel which fits into a sheath of and is connected to the door or shelf. A lever arm carries cam followers which engage a cam in the channel. The cam is supported in the channel by a pin and a spring located on opposite ends of the cam. The cam has a recess and a ramp disposed adjacent to the recess. When an overload is applied to the cantilever end of the door or shelf, the cam followers are disengaged from the recess of the cam, and push the cam inwardly within the channel at an angle to allow the door or shelf to be titled downwardly below the horizontal. This action interrupts the counterbalance spring effect on the door. A pin-hole arrangement resets the hinge device, and a lug-slot arrangement prevents the door from disengaging the hinge device.

64 Claims, 7 Drawing Sheets

ANTI-TIP HINGE DEVICE AND METHOD

BACKGROUND OF THE INVENTION

1. Field of the Invention

The invention relates to a hinge device for a door or shelf of a cabinet or appliance, and more particularly, to an improved hinge device which resists tipping of the cabinet or appliance when an excessive load is applied to the door or shelf which is horizontally and cantileverly disposed.

2. Description of the Prior Art

Numerous horizontal hinge designs for doors and/or shelves are well-known in the art. The doors may be a door on a kitchen oven or some other appliance such as front loading washers and dryers, and the shelves may be part of a bookcase or desk which swing down pivotally to provide a horizontal surface and/or access into the bookcase or desk. In all instances, the door or shelf when opened is generally in a horizontal and a cantilever position. Other examples where this type of door or shelf when opened is used are in ice makers, stereo cabinets, and drop front file cabinets.

The present-day hinge devices are designed such that when an excessive load or an overload is placed on the opened door or shelf, the cabinet or bookcase or appliance tends to tip or fall forward. This creates a dangerous situation for the user which may result in serious injury to the user and/or may result in damage to the cabinet, bookcase, or appliance.

It has been known to employ in an oven of a kitchen stove a lever arm which is attached at one end to a counter-balance spring mounted in an oven and which travels over a roller, which, in turn, is attached to a hinge device mounted to the kitchen stove. The other end of the lever arm is received in a top slot of a channel slideably received in a sheath of the oven door.

It has been further known to employ a sheath in a door of an oven for receiving and securing a channel and hinge device.

An example of present-day hinge devices for an oven door is shown in U.S. Pat. No. 5,025,766 issuing on Jun. 25, 1991. This hinge device does not provide means for releasing the effect of the hinge device when an overload is placed on the opened door.

Therefore, in spite of the prior art devices, there remains a very real and substantial need for an improved hinge device for a door or shelf disposed in a generally horizontal, cantilever fashion, which is simple in construction and which prevents the cabinet, bookcase, or appliance from tipping or falling forward when an overload is placed on the cantilever end.

SUMMARY OF TEE INVENTION

The present invention has met the above-described need. It employs a lever arm which is connected to a counterbalance spring fixed to the unit, such as a stove or cabinet on one end. The lever arm carries a pair of cam followers disposed on opposite sides of the lever arm on the other end. This end of the lever arm is connected to the door or shelf by means of a channel mounted in the door or shelf. The channel is a U-shaped metal piece which fits and is secured in a sheath in the door or shelf assembly. The sheath and channel have a sliding fit which allows the oven door to be removed for cleaning. The sheath is formed in a U-configuration and is made of sheet metal.

The channel has a pair of straight, elongated slots which are aligned relative to each other and carries a movable cam. The cam has a winged portion on its opposite sides and is mounted in the channel by a rivet pin in each winged portion. A coiled spring is mounted around each rivet pin and is fixed to the winged portion in a manner to allow movement of the cam within the channel. The cam has a recess which receives the cam followers when in an operative, normal condition, and a ramp portion which has an elevated portion which helps to define the recess in the cam. The recess and the ramp of the cam are adjacent to the aligned slots in the sides of the channel. A rivet pin which attaches the cam followers to the lever arm extends through the aligned slots on either side of the channel, and is slideable in the aligned slots when the cam followers are forced to travel along the ramp of the cam.

When an excessive load is placed on the cantilevered end of the door or shelf, the cam followers force the cam which is biased upwardly by the coiled springs to be moved or pivoted downwardly at an angle below the horizontal relative to the cantilevered end of the door or shelf, thereby compressing at least the coiled spring nearest the cantilevered end. This movement of the cam causes the cam followers to be disengaged from the recess of the cam, and the rivet pin to travel along and in the aligned slots in the channel with the cam followers rolling along the cam surface. This action of the cam followers against the ramp portion of the cam forces the channel to drop approximately 45 degrees below the horizontal, and the door or shelf to tilt downwardly either striking the floor and/or allowing the load to slide off the door or shelf. A lug and slot arrangement in the door or shelf and in the channel prevents the door or shelf from sliding completely out of the channel.

A reset mechanism consists of an aperture in the lever arm and a pin insertable in the aperture. The pin is placed in the aperture and the door or shelf is raised until the pin engages the frame of the unit. As the door or shelf is raised further, the cam followers ride up the ramp of the cam and slots in the channel until they rest in the normal position in the recess of the cam. The coiled springs allow the cam to retain its normal positioning. The door or shelf is lowered partially and the pin is removed. The unit is ready for normal operation.

Accordingly, it is an object of the present invention to provide an improved hinge device for a door or shelf which when lowered to a generally horizontal, cantilevered position resists the tipping or the falling forward of the unit to which the door or shelf is attached when an excessive load is applied onto the opened door or shelf.

A further object of the present invention is to provide an improved hinge device which releases the door or shelf when in a cantilevered generally horizontal position when an excessive load is applied on the door in a manner to allow the door or shelf to tilt downwardly below the horizontal position either striking the floor or allowing the load to slide off.

A still further object of the present invention is to provide an improved hinge device which allows the door or shelf when in a horizontal cantilevered position to be released from the effect of the hinge device when an overload is applied thereon, and which prevents the door or shelf from being disengaged totally from the hinge device.

A yet further object of the present invention is to provide an improved hinge device which when a door or shelf is released and caused to be in an inoperative position is capable of being reset into an operative position in the unit.

A still further object of the present invention is to provide an improved hinge device which has means for interrupting the effect of a counterbalance spring acting on a door or shelf of a unit when an excessive load is placed upon the door or shelf which is disposed in a generally horizontal cantilevered position.

These and other objects of the present invention will be fully understood and appreciated from the following description of the invention and reference to the illustrations appended hereto.

BRIEF DESCRIPTION OF TEE DRAWINGS

Figure 2:
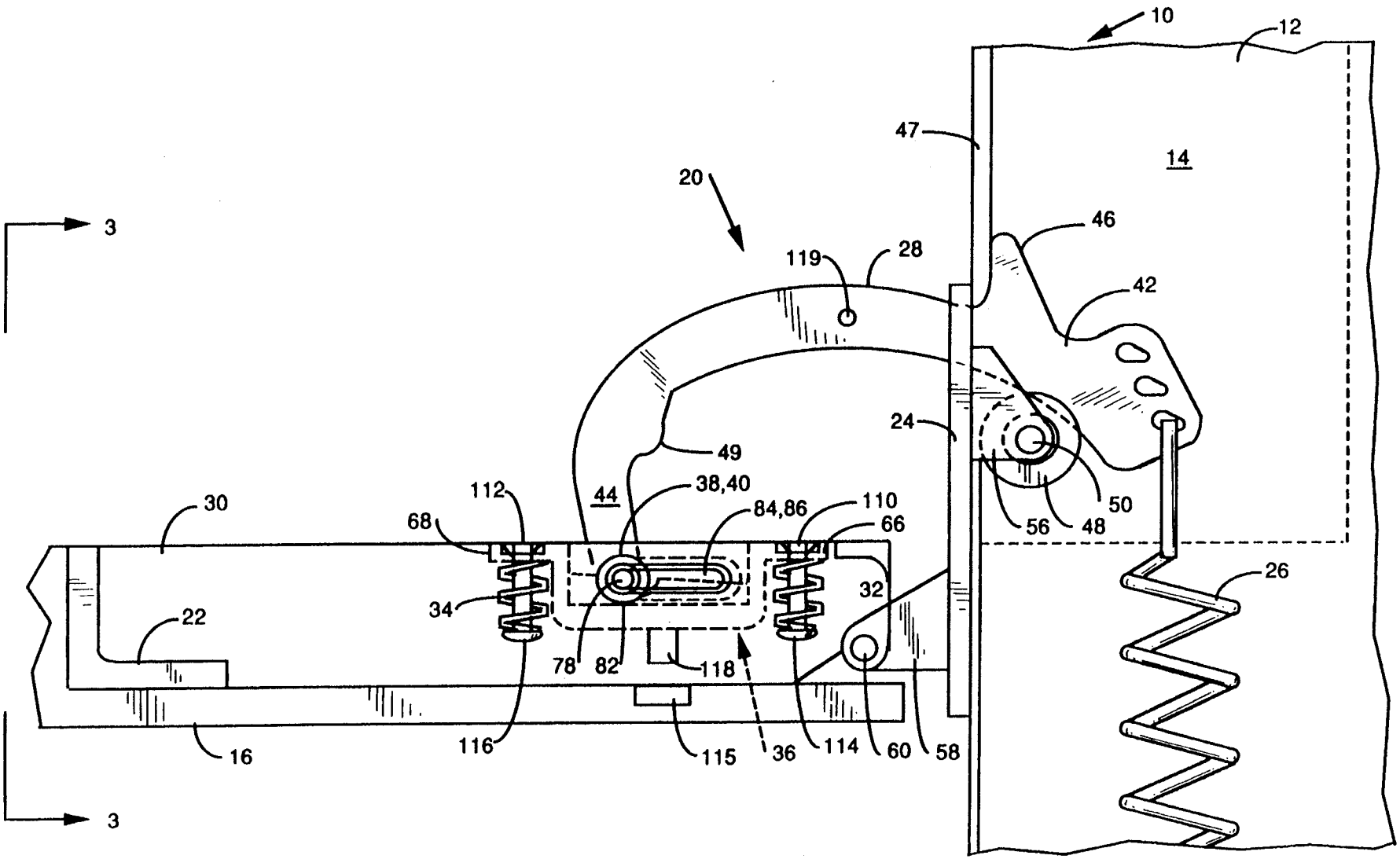
FIG. 2 is an enlarged, side elevation view, partly broken away, showing the hinge device of the present invention employed in FIG. 1.
Figure 4:
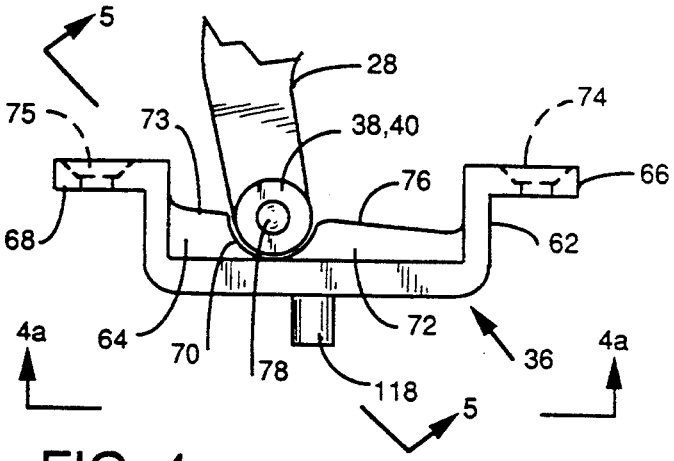
FIG. 4 is a side elevational view, partly broken away, and showing the cam and cam followers of the present invention.
Figure 4A:
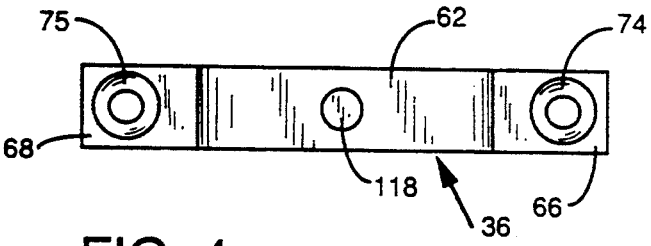
Figure 5:
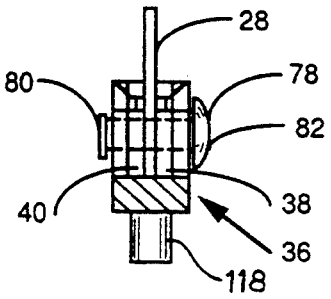
Figure 6:
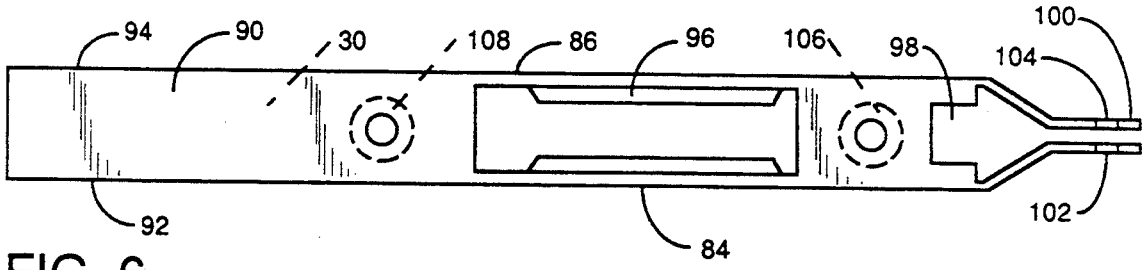
Figure 7:
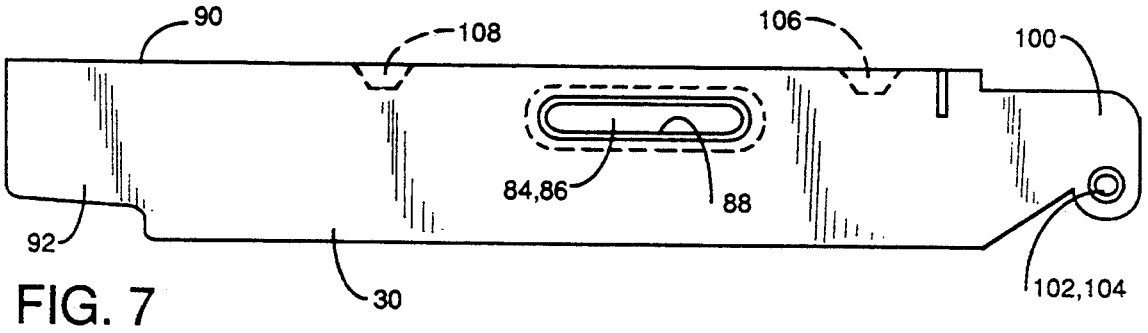
Figure 8:
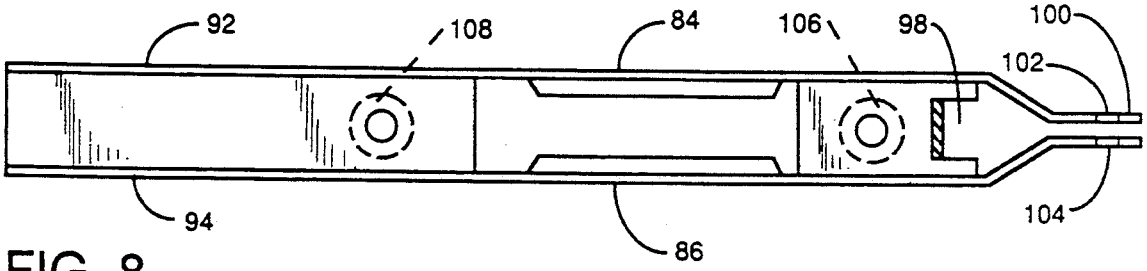
Figure 9:
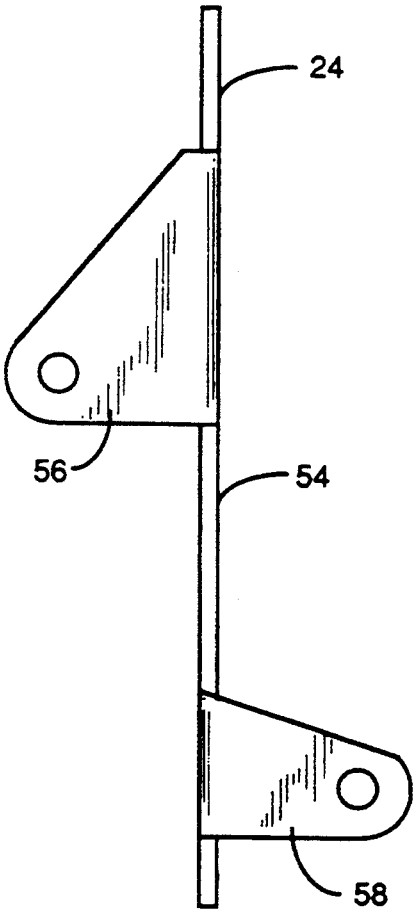
Figure 10:
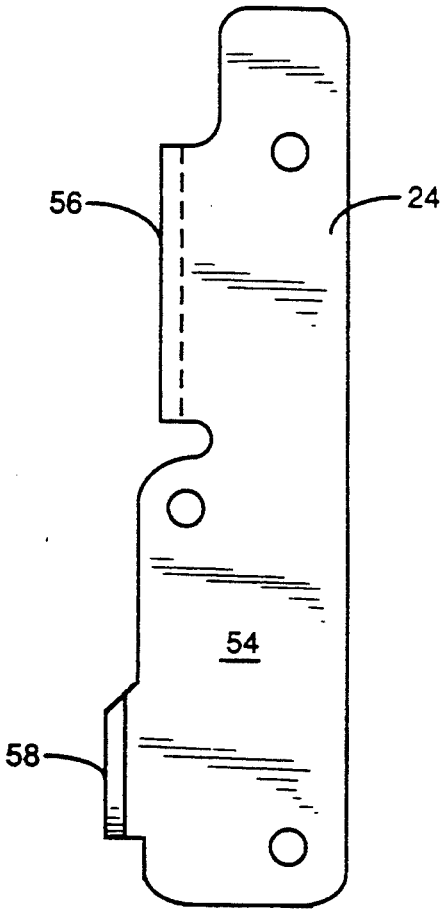
Figure 11:
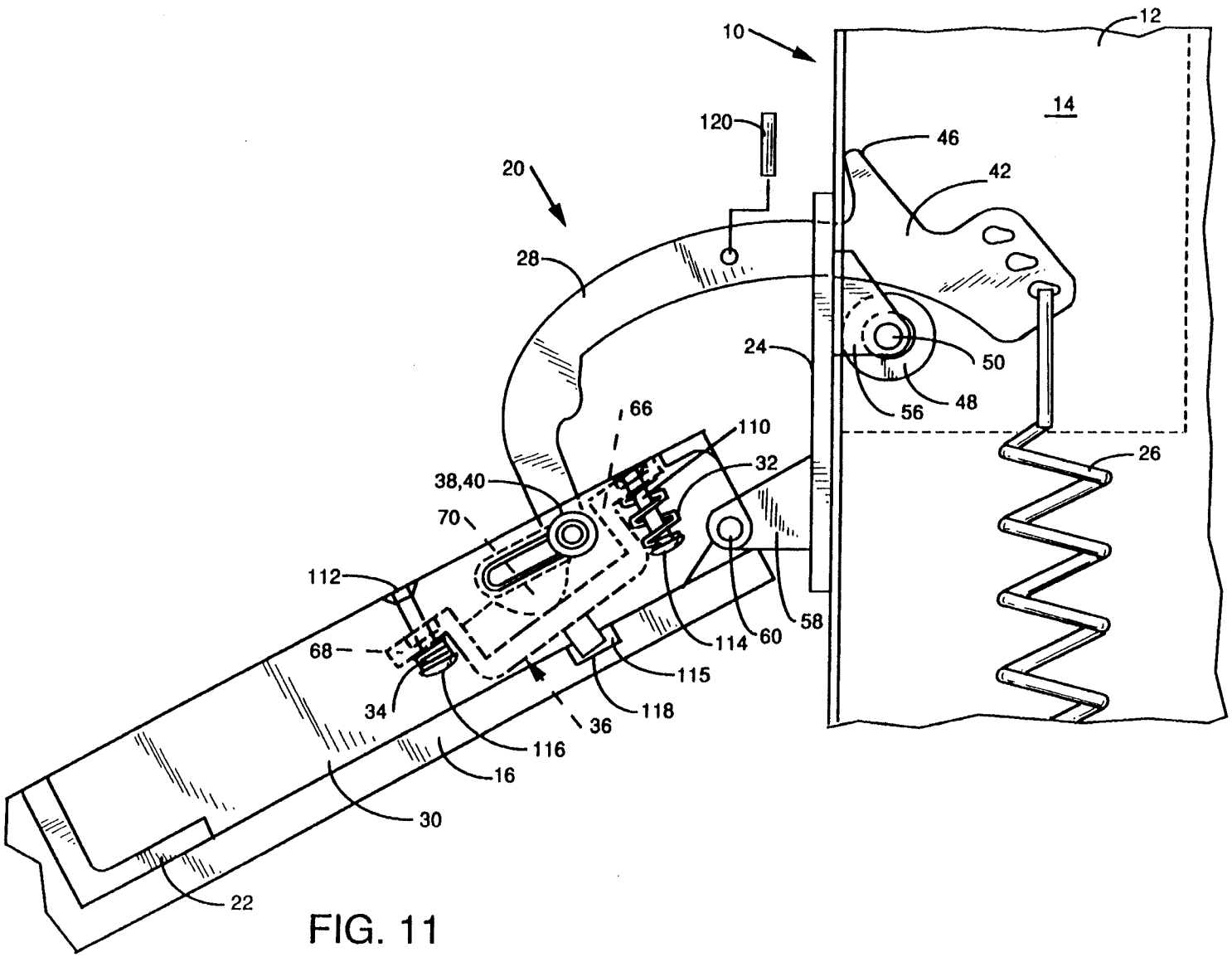
Figure 12:
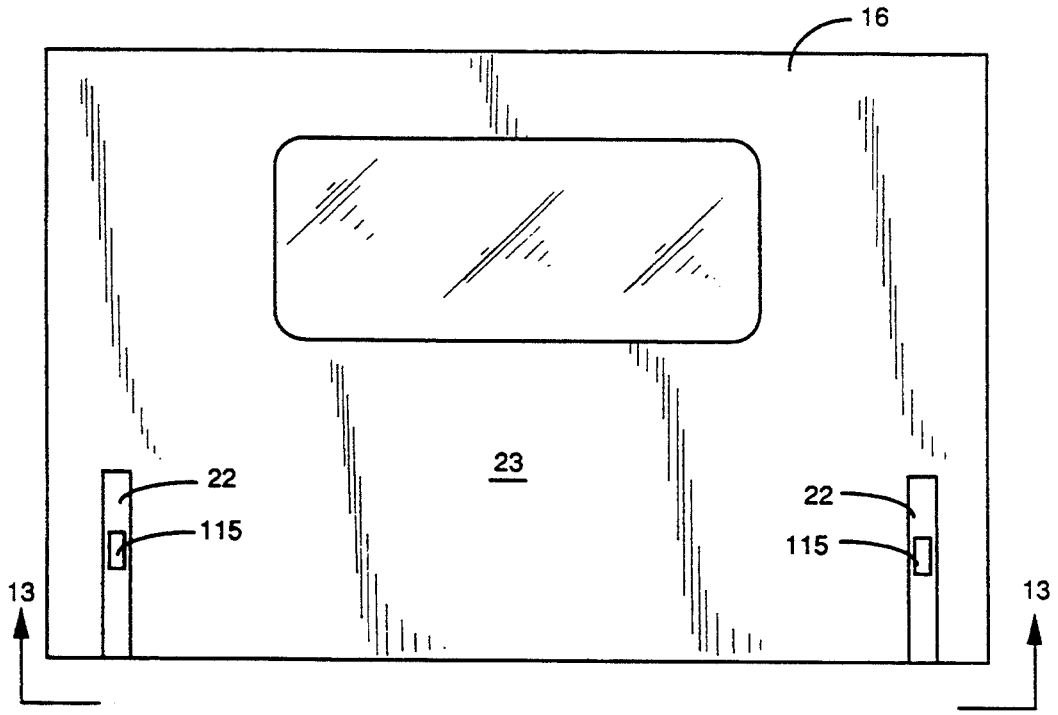
Figure 13:
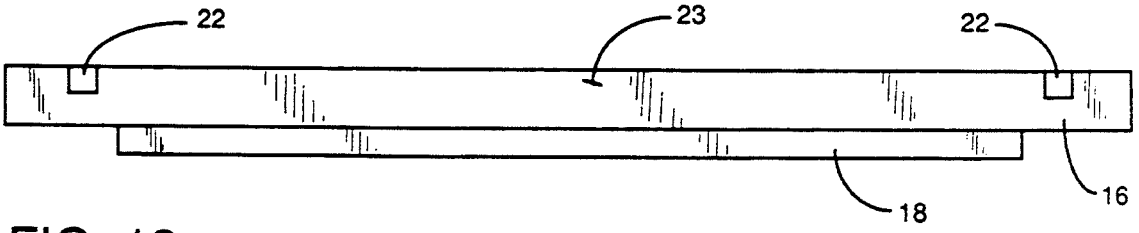

FIG. 4*a* is a bottom view taken along lines 4*a*—4*a* of FIG. 4;

FIG. 5 is a cross-sectional view taken along lines 5—5 of FIG. 4;

FIG. 6 is a top plan view showing a channel for the hinge device of the present invention;

FIG. 7 is a side elevational view of the channel in FIG. 6;

FIG. 8 is a bottom plan view of the channel in FIG. 6;

FIG. 9 is a side elevational view of a hinge plate for the hinge device of the present invention;

FIG. 10 is a front elevational view of the hinge plate in FIG. 9;

FIG. 11 is an enlarged side elevational view, partly broken away, similar to FIG. 2 and showing the hinge device when an overload is applied;

FIG. 12 is a top elevational view showing the inner wall of the oven door in which the hinge device of the present invention is attached; and FIG. 13 is a side elevational view taken along lines 13—13 of FIG. 12.

DETAILED DESCRIPTION OF THE DRAWINGS

For convenience of disclosure, the present invention will be discussed in terms of an improved hinge device connecting a door to an oven of a kitchen stove or range. However, it is to be appreciated that the hinge device of the invention can be employed on a door for any unit, such as an appliance, such as a front load washer or dryer, and it can be employed on a shelf of the type which acts as a door for a desk which is rotatably pulled downwardly to form a shelf, or a file drawer which is slideable outwardly from its cabinet. In each instance, the door or shelf for the unit is horizontally and cantileverly positionable relative to the vertical plane of the unit to which it is attached.

Figure 1:
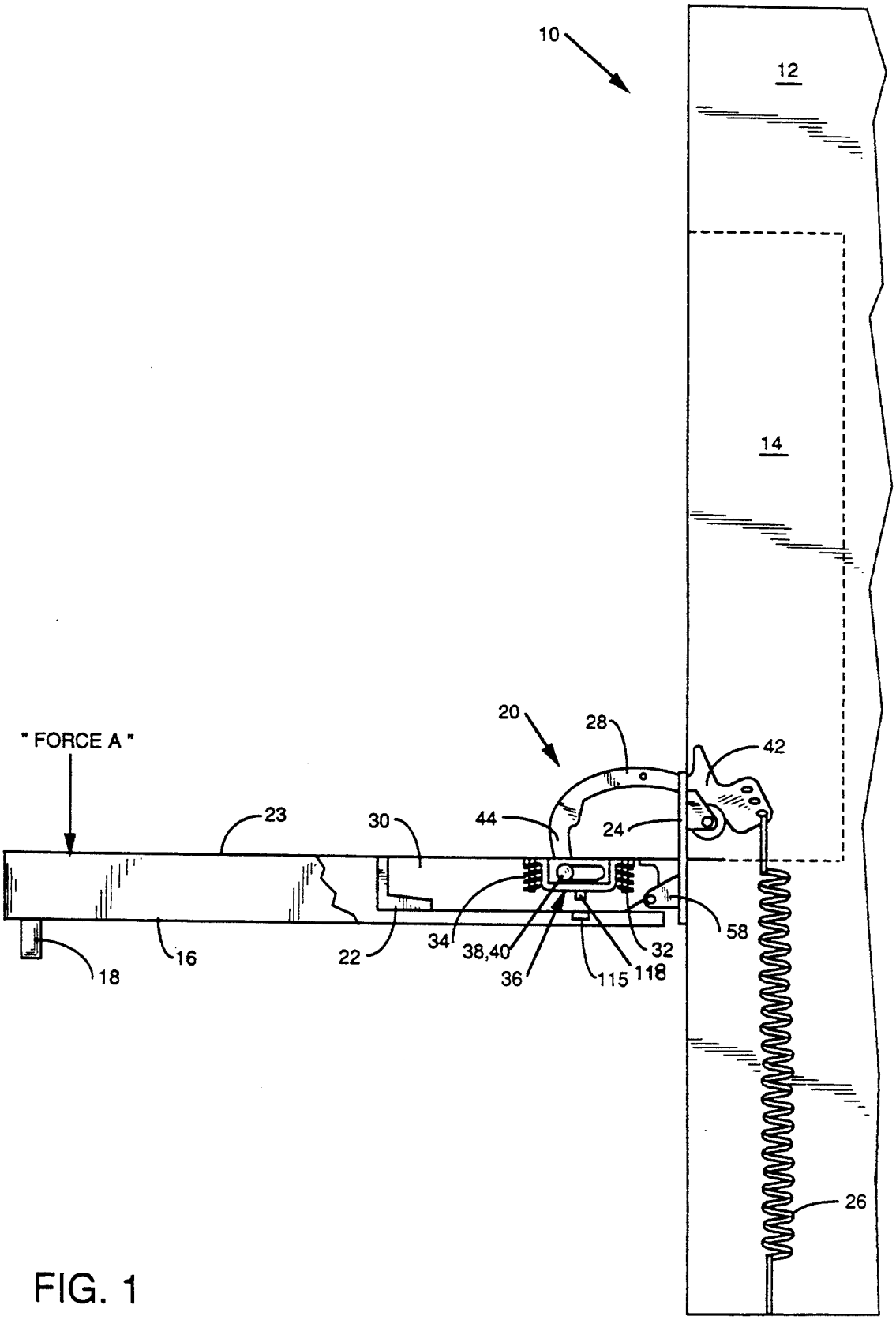
FIG. 1 is a side elevational view, partly broken away showing an oven door in an open position and employing the hinge device of the present invention.

Referring first to FIG. 1, there is shown a range 10 which has a frame 12 which houses an oven cavity 14, and an oven door 16. Door 16 is pulled away from frame 12 to open the oven 14 by handle 18, and is attached to frame 12 by hinge device 20, which even though not shown in FIG. 1 is attached on either side of door 16. Hinge device 20 fits into sheath 22 in the inner sidewall 23 of door 16, more about which will be discussed hereinafter.

Hinge device 20 is connected to the front of frame 12 by hinge plate 24, and is connected to the inside bottom of frame 12 by counterbalance spring 26 which is in tension in FIG. 1 and which is anchored in frame 12 by means which are well-known in the art, such as a hook (not shown) on the end of the spring.

FIGS. 2, 3, 4, 5, 6, 7, 8, 9 and 10 best illustrate the details and construction of hinge device 20, which comprises when referring particularly to FIG. 2, lever arm 28, channel 30, coiled compression springs 32 and 34, cam 36, and cam followers 38, 40, best shown in FIG. 5.

Lever arm 28 is generally a flat, curved plate made from sheet metal and has an end 42 extending into a sidewall of frame 12 of range 10, and an opposite end 44 extending and mounted in channel 30 of hinge device 20.

End 42 of lever arm 28 is fixedly secured to counterbalance spring 26 as best shown in FIG. 1, and has an ear or stop finger 46 which abuts against a front wall 47 of frame 12 inside cavity 14, thereby acting as a stop to limit the amount of pivotal displacement of door 16 away from oven cavity 14 upon opening of the oven. Lever arm 28 engages and slides over guide roller 48, which roller 48 is rotatably mounted to hinge plate 24 by rivet pin 50. Roller 8 has a channeled annular surface as best shown in FIG. 3, and preferably is made of a hard plastic material such as thermoplastic, polyester, or nylon (glass filled).

Lever arm 28 has a projection 49 located inwardly and upwardly from end 44 of lever arm 28, as best shown in FIG. 2. When this projection 49 abuts against roller 48, it allows door 16 to be held in a stable open position at an angle of about 15 to 20 degrees relative to the vertical plane of range 10.

Figure 3:
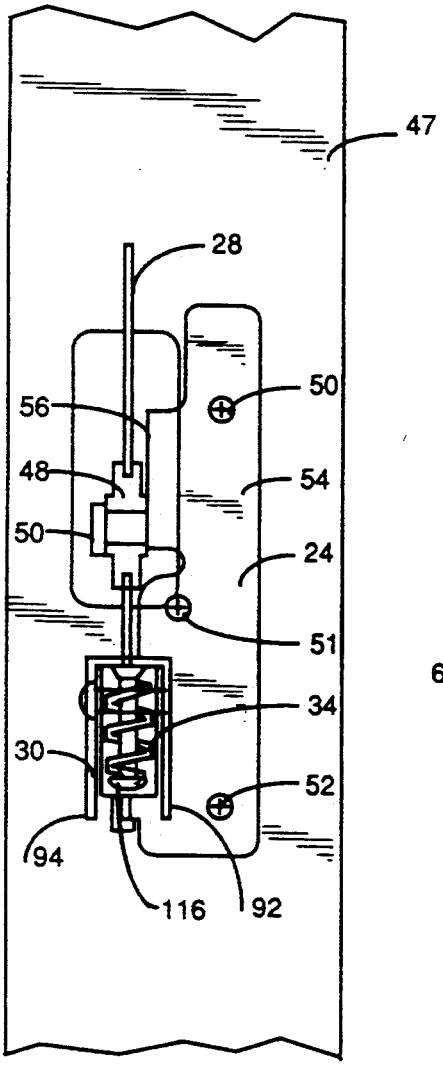
FIG. 3 is a view taken along lines 3—3 of FIG. 2.

As seen in FIG. 3, hinge plate 24 is fixedly mounted to the front wall 47 of frame 12 by fasteners, such as screws 50, 51 and 52. Hinge plate 24 has a main flat body portion 54 as shown in FIGS. 3 and 10, and flat bracket members 56 and 58 as best shown in FIGS. 2 and 10. Members 56 and 58 extend outwardly in opposite directions and are arranged perpendicularly relative to flat body portion 54 of hinge plate 24.

Hinge plate 24 preferably is made from sheet metal, and may be of the same material as lever arm 28.

As particularly shown in FIG. 2, bracket member of hinge plate 24 extends rigidly away from front wall 47 of frame 12, and is fixedly connected to channel 30 by fastening means, such as rivet pin 60.

FIGS. 4, 4*a* and 5 best illustrate cam 36, and cam followers 38 and 40 mounted on lever arm 28. FIGS. 6, 7 and 8 best illustrate the construction and design of channel 30. FIGS. 9 and 10 best show hinge plate 24. FIG. 11 best illustrates hinge device 20 in a tripped position when an overload is applied to the cantilever end of oven door 16. FIGS. 12 and 13 best illustrate oven door 16, and sheaths 22 on both sides of oven door 16.

Referring particularly to FIGS. 4 4*a*, and 5, cam assembly 36 consists of a generally U-shaped outer portion 62 and an inner portion 64 in outer portion 62. Outer portion 62 has winged ends 66 and 68. Inner portion 64 has a recess 70 which receives cams 38 and 40, a ramp portion 72 located adjacent to recess 70 of inner portion 64, and a sloped portion 73 adjacent to recess 70 opposite to ramp portion 72. The different portions 62, 64, 66, 68, 70, 72 and 73 of cam assembly 36 is preferably a one piece aluminum die casting.

Winged ends 66 and 68 of portion 62 of cam assembly 36 have an aperture 74, 75, respectively, more about which will be discussed hereinafter.

In normal operation of oven door 16, which involves the pivoting of door 16 to open and close oven cavity 14 where door 16 is moved from a vertical position to a generally horizontal position, cam followers 38, 40 are received in recess 70 of inner portion 64 of cam 36. Cam followers 38, 40 are forced therefrom, and caused to engage and travel along the top surface 76 of ramp portion 72 of inner portion 64 of cam assembly 36 toward winged end 66 of portion 64 when an overload represented in FIG. 1 as "Force A" is applied to oven door 16.

As particularly shown in FIGS. 4 and 5, cam followers 38, 40 are annular members or washers which are rotatably mounted on either side of lever arm 28 by fastening means, such as rivet pin 78, best shown in FIG. 5. Rivet pin 78 extends through cam followers 38, 40 and lever arm 28. Rivet pin 78 has a blunt formed annular end 80 and a head 82, more about which will be discussed hereinafter. As is known in the art, rivet pin 78 can be set on a tubular rivet setting machine to form annular end 80 and head 82.

As best shown in FIG. 11, and referring again to FIGS. 1 and 2, blunt end 80 and head end 82 of rivet pin 78 extend through aligned, elongated straight slots 84, 86 of channel 30 shown in FIGS. 6, 7 and 8 and engage inner surface 88 (FIG. 7) of aligned slots 84, 86. FIGS. 6, 7, 8 best illustrate the details and construction of channel 30.

Channel 30 is an elongated, generally inverted U-shaped member (FIG. 3) with an upper top wall 90, as particularly shown in FIGS. 6 and 7, and opposed side walls 92, 94 in which slots 84, 86, respectively, are formed. Top surface 90 of channel 30 has a generally rectangular opening 96 which extends the length of inner portion 64 of cam 36 and which allows cam followers 38, 40 to be received in recess 70 of inner cam portion 64. Top surface 90 extends substantially the length of channel 30, and stops short of side walls 92 and 94 to form a U-section at its one end identified at number 98 as indicated to the far right of FIGS. 6 and 8. Side walls 92 and 94 extend substantially beyond top wall 90 and converge to form a clevis 100. Apertures 102 and 104 are formed in sidewalls 92, 94, respectively, in clevis 100 as shown to the far right of FIGS. 6, 7 and 8.

Clevis 100 receives rivet pin 60 for connection of channel 30 to bracket member 58 of hinge plate 24, as shown particularly in FIGS. 2 and 11, and as discussed hereinabove.

Still referring to FIGS. 6, 7, and 8, channel 30 has circular tapered downwardly converging apertures 106 and 108 located in top wall 90 on either side of rectangular opening 96. Referring also to FIGS. 2 and 11, these apertures 106 and 108 in channel 30 correspond to apertures 74 and 75, respectively, of outer portion 62 of cam 36, and are formed to receive elongated rivet pins 110 and 112, shown best in these FIGS. 2 and 11. When cam assembly 36 is inserted in channel 30, it is secured therein by rivet pin 110 in apertures 74 and 106, and rivet pin 112 in apertures 75 and 108. As particularly shown in FIGS. 2 and 11, coiled springs 32 and 34, respectively, are mounted around rivet pins 110 and 112, with their one end abutting head 114, 116 of rivet pins 110, 112, respectively, and their other end abutting winged ends 66, 68 of cam assembly 36.

This arrangement of cam assembly 36 and its mounting by rivet pins 110 and 112 with coiled springs 32 and 34, particularly illustrated in FIGS. 2 and 11, allows winged ends 66 and 68 of cam assembly 36 to be pivoted or to be moved up and down along rivet pins 110, 112, as particularly shown in FIG. 11 when hinge device 20 is tripped by an overload.

Referring now to FIGS. 12 and 13, oven door 16 has two sheaths 22, one located on either side of door 16 along its width. These sheaths 22 consist of elongated U-shaped channels formed in the inner sidewall 23 of door 16 and are made to correspond to and to receive channel 30 of hinge device 20. Each sheath 22, preferably, has a liner formed by sheet metal which is spot welded to the surface of door 16. The surfaces of channel 30 and sheath 22 are such that channel 30 is slideable in sheath 22.

A hinge device 20 is provided in each of sheaths 22 of door 16. Hinge device 20 is connected to door 16 on each of its sides. Channel 30 is flushed with the inner sidewall 23 of door 16. Each sheath 22 of door 16 is such that it can slide over the channel 30 of hinge device 20. This allows door 16 to be slid off of channel 30 for cleaning. Each sheath 22 has a slot 115 as particularly shown in FIGS. 1, 2, 11 and 12. This slot 115 in sheath 22 receives a retaining lug 118 as best shown in FIGS. 4 and 11, which is integrally formed in U-shaped portion 62 of cam assembly 36. After the anti-tip hinge mechanism 20 of the present invention has been tripped by an overload applied to the cantilevered end of door 16, retaining lug 118 of both hinge mechanisms 20 engages its respective slot 115 in sheath 22 of oven door 16, thereby preventing door 16 from sliding out of channels 30 of each hinge device 20. This condition is best shown in FIG. 11.

A more detailed explanation of the operation of the anti-tip hinge device 20 of the present invention will now be given with particular reference to FIGS. 1, 2 and 11. It is to be appreciated that in order to open the oven, the user of range 10 pulls oven door 16 away from frame 12 so that door 16 swings downwardly to attain a generally horizontal, cantilever position as shown in FIGS. 1 and 2. The weight of door 16 in this position exceeds that of the weight of counterbalance spring 26, and the construction and arrangement of hinge 20 maintains door 16 in this position of FIGS. 1 and 2, whereby cam followers 38, 40 are retained in recess 70 of cam portion 64, while door 16 is being lowered. Both coiled springs 32 and 34 of the two hinge mechanisms 20 are in a pre-loaded condition.

When "Force A" of FIG. 1 is applied to the door 16, door 16 is forced downwardly at an angle of approximately 45 degrees below the horizontal positioning of door 16, and since lever arm 28 is held in a fixed position by ear or stop portion 46 of arm 28 abutting against the inside wall of oven cavity 14, cam followers 38 and 40 are forced out of recess 70 and are caused to engage surface 76 of ramp portion 72 of inner cam portion 64, with annular portions 80 and 82 of rivet pin 78 sliding along inner surface 88 of slots 84 and 86 in channel 30, as shown in FIG. 11. This action forces cam assembly 36 against springs 32 and 34, and the weight of door 16 falling downwardly by gravity causes spring 34 to become loaded or compressed, while door 16 slides partially out of channel 30. Lug 118 of each cam 36 engages slots 115 in sheaths 22, preventing door 16 from sliding entirely out of channel 30.

Hinge device 20 can be set back into an operative position of FIGS. 1 and 2 from its inoperative position of FIG. 11. This is accomplished by providing an aperture 119 in lever arm 28 as particularly shown in FIG. 2. A pin, similar to that shown at number 120 in FIG. 11 is placed in aperture 119, and door 16 is raised until pin 120 engages the front sidewall of frame 12 of oven 10. Pin 120 can be a piece of rod as shown in FIG. 11, which would be furnished with range 10, or it can be a ten penny nail, or a small screwdriver.

As door 16 is being raised, cam followers 38 and 40 are forced to ride back up ramp portion 72 of cam 36 with rivet pin 78 in slots 84, 86 of channel 30, until cam followers 38, 40 go into recess 70 of inner portion 64 of cam assembly 36 causing door 16 to be slightly lowered, and ready for normal operation of range 10 with oven door 16 now under the effect of counterbalance spring 26.

An example of the dimensions for the components of hinge device 20 will now be given. The length of sloped portion 73 of inner portion 64 is about 0.4745 inches measured from winged end 68 of outer portion 62 to recess 70 of inner portion 64. The length of ramp portion 72 is preferably about 1.1875 inches, and has a slope of about 7.0 degrees from the base of inner portion 64. This slope can range from about 6.5 to about 7.5 degrees. The depth of recess 70 is preferably about 0.305 inches measured from sloped portion 73 of inner portion 64 which is opposite to that of ramp portion 72 shown to the far right of FIG. 4. Recess 70 is generally a circular configuration with a radius of about 0.3125 inches. The length of aligned slots 84, 86 in channel 30 is about 1.43 inches, and the height of aligned slots 84, 86 is about 0.250 inches. The length of slots 84, 86 is about 62.5% relative to the combined length of recess 70, ramp portion 72, and sloped portion 73 of inner portion 64. The thickness of cam followers 38, 40 is about 0.097 inches and the diameter of cam followers 38, 40 is about 0.622 inches. The length of the shaft (not shown) of rivet pin 78 affixing cam followers 38, 40 to lever arm 28 is about 0.450 inches.

The amount of "Force A" required to cause door 16 to fall pivotally downwardly below the horizontal position of FIGS. 1 and 2, and cam followers 38 and 40 to be tripped out of recess 70 and along ramp portion 72 is about 75 to 90 pounds applied anywhere on door 16. Higher or lower trip settings are available by using different spring constants for springs 32 and 34. The spring constant K, for coiled springs 32 and 34 is about 155 lbs./inch and the type of springs, for this application, are preferably chromium silicon wire which is heat treated. These springs 32 and 34 can be furnished by Economy Spring Company, Southington, Conn. The tension for counterbalance spring 26 depends on the weight of the door.

The maximum weight one can put anywhere on door 16 is less than about 75 pounds without running the risk of hinge device 20 on either side of oven door 16 being tripped, and as stated hereinbefore, anywhere between 75 and 90 pounds will trip hinge device 20.

It will be appreciated that the invention provides for an improved hinge device for an oven door 16 which prevents the undesirable tipping or falling forward of range 10 when an overload is applied to door 16 when in a cantilever position. This is done by employing a cam 36 having a ramped section 72 and spring assemblies 32, 34 which allow movement of the cam 36 by the force of a cam follower assembly 38, 40 which, in turn, travels along the cam 36, resulting in door 16 tilting downwardly either striking the floor and/or allowing the overload to slide off of door 16. Means are provided to prevent door 16 from totally disengaging channel 30, and a resetting mechanism allows door 16 to be replaced in its operative condition.

Whereas, particular embodiments have been described above for purposes of illustration, it will be appreciated by those skilled in the art that numerous variations of the details may be made without departing from the invention as described in the appended claims. For instance, door 16 may be a door on any other front load appliance, or may be a door on a desk or file cabinet.

In accordance with the provisions of the patent statutes, we have explained and described what we consider to be the best embodiment thereof.

We claim:

1. A release hinge device for releasing a door when an overload is applied to said door, and said door is pivotally secured to a unit for pivotal movement in a first angular direction and for retaining said door in a generally horizontal position in a cantilever fashion relative to said unit, and wherein said door has sheath means for receiving said release hinge device, said release hinge device comprising:

a lever arm having a first and a second end, counterbalance spring means having one end attached to said first end of said lever arm and another end attached to said unit for allowing said pivotal movement of and said retaining of said door in said horizontal position, cam follower means rotatably mounted to said second end of said lever arm, channel means secured in said sheath means of said door and having elongated slot means and connected to said door and to said unit for said pivotal movement of said door, cam means mounted in said channel means and having a recess and ramp means located adjacent to said recess, and being disposed between said slot means of said channel means, said cam follower means engageable with said cam means and having mounting means for said rotatable mounting of said cam follower means to said lever arm and engageable with said slot means, and being in an operative position when in said recess of said cam means, and biasing means connected to said cam means and said channel means for allowing movement of said cam means and movement of said cam follower means from said recess and along said ramp means of said cam means, and for causing said mounting means of said cam follower means to move along said slot means of said channel means to interrupt the effect of said counterbalance spring means on said hinge device and to allow further angular displacement of said door from said horizontal position when said overload is applied to said door.

2. A release hinge device of claim 1, wherein said recess of said cam means has a depth of about 0.305 inches relative to said ramp means and a radius of about 0.3125 inches.

3. A release hinge device of claim 1, wherein said ramp portion of said cam means has a length of about 1.1875 inches, and a slope of about 6.5 to about 7.5 degrees.

4. A release hinge device of claim 1, wherein said slot means in said channel means are generally straight and has a length of about 1.43 inches, and a height of about 0.250 inches.

5. A release hinge device of claim 1, wherein said cam means has a relatively sloped portion adjacent to said recess opposite to said ramp portion, and wherein the length of said slot means in said channel means is about 62.5% relative to the combined length of said sloped portion, said recess, and said ramp portion of said cam.

6. A release hinge device of claim 1, wherein said cam follower means has a diameter of about 0.622 inches, and a thickness of about 0.097 inches.

7. A release hinge device of claim 1, wherein said cam means comprises:

an outer portion which is generally in a U-shaped configuration, and an inner portion in said outer portion and having said recess and said ramp portion.

8. A release hinge device of claim 7, wherein said cam means is a one piece aluminum die casting.

9. A release hinge device of claim 7, wherein said outer portion of said cam means has a winged portion located adjacent to and at each end of said inner portion.

10. A release hinge device of claim 1, further comprising:

means for attaching said biasing means to said cam means and for connecting said cam means to said channel means.

11. A release hinge device of claim 1, wherein said channel means has generally a U-shaped configuration in cross-section, at least two opposed sidewalls, and a top wall connecting said two opposed sidewalls, and wherein each said sidewall contains said slot means and whereby said slot means in said each sidewall are aligned relative to each other.

12. A release hinge device of claim 1, wherein said channel means has sidewalls and a top wall, and wherein said slot means of said channel means is generally a straight, elongated aperture located in each of said sidewalls of said channel means.

13. A release hinge device of claim 12, wherein said top wall of said channel means has an aperture for receiving said cam follower means and said lever arm, and in communication with said slot means.

14. A release hinge device of claim 1, further comprising:

bracket plate means mounted to said unit, and having a main body, a first bracket member, and a second bracket member, said first bracket member and said second bracket member arranged cantileverly and perpendicularly relative to said main body, and projecting outwardly in opposite directions.

15. A release hinge device of claim 14, further comprising:

roller means mounted on said first bracket member for engagement and support of said lever arm, and fastening means associated with said second bracket member for rotatably securing said channel means to said unit.

16. A release hinge device of claim 15, wherein said lever arm further comprises projection means located in close proximity to said second end of said lever arm for abutting said roller means and allowing said door to be placed in a partial open condition relative to said unit during said engagement of said lever arm with said roller means.

17. A release hinge device of claim 1, wherein said lever arm has a generally arcuate configuration, and further comprises finger means near said first end for limiting said angular displacement of said door upon said retaining of said door in said horizontal position.

18. A release hinge device of claim 1, further comprising:

retainer means for maintaining said connection of said channel means to said door upon said further angular displacement of said door from said horizontal position.

19. A hinge device of claim 18, wherein said retainer means consists of slot means in said sheath means of said door and lug means associated with said cam means, and wherein said lug means is located in close proximity to said slot means of said sheath means of said door for engagement in said slot means upon said further angular displacement of said door from said horizontal position.

20. A release hinge device of claim 1, further comprising:

resetting means for reactivating said effect of said counterbalance spring means.

21. A release hinge device of claim 20, wherein said resetting means consists of aperture means in said lever arm located in close proximity to said first end of said lever arm, and pin means insertable in said aperture means and engageable with a surface of said unit when said door is moved angularly in a second angular direction opposite to said first angular direction for positioning said door adjacent to said surface of said unit.

22. A release hinge device of claim 21, wherein said cam means includes means for causing said cam follower means to move along said slot means of said channel means and back into said recess for said operative position of said cam follower means upon activation of said resetting means.

23. A release hinge device of claim 1, wherein said means of said cam follower means engageable with said slot means of said channel means consists of pin means for said rotatable mounting of said cam follower means, and wherein said pin means travels in said slot means upon said further angular displacement of said door from said horizontal position.

24. A release hinge device of claim 1, further comprising:

means for fixedly connecting said channel means directly to said door and to said unit for pivotable movement of said door.

25. A release hinge device of claim 1, further comprising:

stop means associated with said lever arm for limiting the movement of said lever arm in said first angular direction and for preventing further movement of said lever arm upon said further angular displacement of said door from said horizontal position.

26. A release hinge device of claim 1, wherein said door has said sheath means on opposite transverse ends, and said release hinge device mounted in each said sheath means.

27. A release hinge device of claim 1, wherein said unit is an appliance.

28. A release hinge device of claim 27, wherein said appliance is a kitchen stove.

29. A release hinge device of claim 1, wherein said biasing means includes coiled spring means mounted to said cam means and said channel means on each side of said cam means.

30. A release hinge device of claims 1, wherein said cam follower means consist of at least two cam followers rotatably mounted to said lever arm by rivet means which is captivity mounted in said slot means for movement therealong and for movement of said cam followers along said cam means.

31. A release hinge device of claim 1, wherein said slot means run longitudinally relative to said channel means, and oriented generally parallel to the path of travel of said cam follower means.

32. In combination, a unit having a cavity opening in the front wall thereof, and a door pivotally mounted to said unit to close said opening, wherein said door has sheath means, and a pair of release hinge devices mounting said unit door to close said cavity, each of said release hinge devices, comprising:

a lever arm having a first end and a second end, counterbalance spring means having one end attached to said first end of said lever arm and another end attached to said unit for allowing pivotal movement of said door in the opening and closing of said cavity and for retaining said door in a generally horizontal, cantilever position in said opening of said cavity, cam follower means rotatably mounted at said second end of said lever arm, channel means in said sheath means of said door and having elongated slot means and connected to said door and to said unit for said pivotal movement of said door relative to said unit, cam means mounted in said channel means and having a recess and adjacent ramp means and being disposed between said slot means of said channel means, said cam follower means engageable with said cam means and having mounting means for said rotatable mounting of said cam follower means to said lever arm and engageable with said slot means, and being in an operative position when in said recess of said cam means, and biasing means connected to said cam means and said channel means for allowing pivotal movement of said cam means and movement of said cam follower means from said recess and along said ramp means of said cam means, and for causing said mounting means of said cam follower means to move along said slot means of said channel means to interrupt the effect of said counterbalance spring means on said pair of hinge devices and to cause said door of said unit to be angularly displaced from said horizontal, cantilever position when an overload is applied to said door.

33. The combination of claim 32, wherein said cam means comprises:

an outer portion which is generally in a U-shaped configuration, and an inner portion mounted in said outer portion and having said recess and said ramp portion.

34. The combination of claim 33, wherein said cam means is a one piece aluminum die casting.

35. The combination of claim 33, wherein said outer portion of said cam means device has a winged portion located adjacent to and at each end of said inner portion.

36. The combination of claim 32, further comprising:

means for attaching said biasing means to said cam means and for connecting said cam means to said channel means.

37. The combination of claim 32, wherein said channel means has generally a U-shaped configuration in cross-section, at least two opposed sidewalls, and a top wall connecting said two opposed sidewalls, and wherein each said sidewall contains said slot means and whereby said slot means in said each sidewall are aligned relative to each other.

38. The combination of claim 32, wherein said channel means has sidewalls and a top wall, and wherein said slot means of said channel means is generally a straight, elongated aperture located in each of said sidewalls of said channel means.

39. The combination of claim 38, wherein said top wall of said channel means has an aperture for receiving said cam follower means and said lever arm, and in communication with slot means.

40. The combination of claim 32, further comprising:

bracket plate means mounted to said unit, and having a main body, a first bracket member, and a second bracket member, said first bracket member and said second bracket member arranged cantileverly and perpendicularly relative to said main body, and projecting outwardly in opposite directions.

41. The combination of claim 40, further comprising:

roller means mounted on said first bracket member for engagement and support of said lever arm, and fastening means associated with said second bracket member for rotatably securing said channel means to said unit.

42. The combination of claim 41, wherein said lever arm further comprises projection means located in close proximity to said second end of said lever arm for abutting said roller means and allowing said door to be placed in a partial open condition relative to said unit during said engagement of said lever arm with said roller means.

43. The combination of claim 32, wherein said lever arm has a generally arcuate configuration, and further comprises finger means near said first end for limiting said angular displacement of said door upon said retaining of said door in said horizontal position.

44. The combination of claim 32, further comprising:

retainer means for maintaining said connection of said channel means to said door upon said further angular displacement of said door from said horizontal position.

45. The combination of claim 44, wherein said retainer means consists of slot means in said sheath means of said door and lug means associated with said cam means, and wherein said lug means is located in close proximity to said slot means of said sheath means of said door for engagement in said slot means upon said further angular displacement of said door from said horizontal position.

46. The combination of claim 32, further comprising:

resetting means for reactivating said effect of said counterbalance spring means.

47. The combination of claim 46, wherein said resetting means consists of aperture means in said lever arm located in close proximity to said first end of said lever arm, and pin means insertable in said aperture means and engageable with a surface of said unit when said door is moved to close said cavity.

48. The combination of claim 47, wherein said cam means includes means for causing said cam follower means to move along said slot means of said channel means and back into said recess for said operative position of said cam follower means upon activation of said resetting means.

49. The combination of claim 32, wherein said means of said cam follower means engageable with said slot means of said channel means consists of rivet pin means for said rotatable mounting of said cam follower means, and wherein said rivet pin means travels in said slot means upon said further angular displacement of said door from said horizontal position.

50. The combination of claim 32, further comprising:

means for fixedly connecting said channel means directly to said door and to said unit for pivotable movement of said door.

51. The combination of claim 32, further comprising:

stop means associated with said lever arm for limiting the movement of said lever arm in the opening of said cavity and for preventing further movement of said lever arm upon said further angular displacement of said door from said horizontal position.

52. The combination of claim 32, wherein said door has said sheath means on opposite transverse ends, and one release hinge device of said pair of release hinge devices mounted in one of said sheath means.

53. The combination of claim 32, wherein said unit is an appliance.

54. The combination of claim 53, wherein said appliance is a kitchen stove.

55. The combination of claim 32, wherein said biasing means includes coiled spring means mounted to said cam means and said channel means on each side of said cam means.

56. The combination of claim 32, wherein said cam follower means consist of at least two cam followers rotatably mounted to said lever arm by rivet means which is captivity mounted in said slot means for movement therealong and for movement of said cam followers along said cam means.

57. The combination of claim 32, wherein said slot means run longitudinally relative to said channel means, and oriented generally parallel to the path of travel of said cam follower means.

58. An anti-tip release mechanism in a hinge device which includes a lever for connecting a door to a unit and which includes a hinge member for pivotally securing said door to said unit, which said release mechanism automatically releases said door when an excessive load is placed on said door when said door is in an open cantilever position, thereby preventing said unit from falling over, said release mechanism comprising:

cam means mounted in said door for pivotal movement therein, and having a recess and adjacent ramp means, cam follower means engageable with said cam means and being in an operative position when in said recess of said cam means, said cam follower means being mounted to one end of said lever, and biasing means connected to said cam means and to said hinge device for said pivotal movement of said cam means and movement of said cam follower means from said recess and along said ramp means of said cam means to cause said door when in said open position to be angularly displaced when said overload is applied to said door.

59. A release mechanism of claim 58, wherein said cam means comprises:

an outer member which is generally in a U-shaped configuration, and an inner member mounted in said outer member and having said recess and said ramp portion.

60. A release mechanism of claim 59, wherein said cam means is a one piece aluminum die casting.

61. A release mechanism of claim 59, wherein said outer member of said cam means has winged portions, each said winged portion located adjacent to and at opposite ends of said inner member.

62. A release mechanism of claim 58, further comprising:

means for attaching said biasing means to said cam means and for connecting said cam means to said hinge device.

63. A release mechanism of claim 58, wherein said cam follower means consists of at least two cam followers rotatably mounted to said one end of said lever of said hinge device by rivet means.

64. A method for safely releasing a door pivotally connected to a unit by a hinge device when an excessive load is placed on said door when in an open condition, to prevent said unit from falling over, the steps comprising:

attaching a first part of said hinge device to said unit and a second part to said door, providing a lever arm connected at one end to a counterbalance spring means in said unit and cam follower means mounted on the other end of said lever arm, providing cam means in said second part of said hinge device and having a recess and adjacent ramp means, engaging said cam follower means in said recess of said cam means for an operative condition of said door from a generally vertical position parallel to said unit, to a generally horizontal and cantilevered position, relative to said unit, providing biasing means connected to and on either side of said cam means for allowing pivotal movement of said cam means, applying said excessive load on said door, and causing said biasing means in close proximity to the cantilevered end of said door to be compressed and said cam means to be pivotted thereby forcing said cam follower means to be snapped out of said recess of said cam means and to engage and travel along said ramp portion of said cam means, resulting in said door being released from the effect of said hinge device.

* * * * *